US005225628A

United States Patent [19]

Heiny

[11] Patent Number: 5,225,628

[45] Date of Patent: Jul. 6, 1993

[54] HIGH IMPACT-LOW PENETRATION ROUND

[76] Inventor: Michael L. Heiny, 12223 Oak Knoll Rd., Poway, Calif. 92064

[21] Appl. No.: 881,672

[22] Filed: May 12, 1992

[51] Int. Cl.[5] ..... F42B 7/10; F42B 10/48; F42B 8/12

[52] U.S. Cl. ..... 102/438; 102/439; 102/562; 102/517

[58] Field of Search ..... 102/438, 502, 529, 507, 102/517, 526, 439, 430

[56] References Cited

U.S. PATENT DOCUMENTS

| | | | |
|---|---|---|---|
| 3,733,727 | 5/1973 | Jones et al. | 102/502 |
| 3,865,038 | 2/1975 | Barr | 102/502 |
| 3,906,859 | 9/1975 | Smith | 102/529 |
| 3,952,662 | 4/1976 | Greenlees | 102/529 |
| 3,982,489 | 9/1976 | Flatau et al. | 102/502 |
| 4,173,930 | 11/1979 | Faires | 102/529 |
| 4,733,611 | 3/1988 | Jonay et al. | 102/438 |
| 4,823,702 | 4/1989 | Woolsey | 102/502 |
| 4,942,818 | 7/1990 | Saxby | 102/502 |
| 4,949,644 | 8/1990 | Brown | 102/501 |
| 5,009,164 | 4/1991 | Grinberg | 102/502 |

OTHER PUBLICATIONS

Advertising Brochure, Special Tactical Shotgun Ammunition, Accuracy Systems Ordnance Corp., P.O. Box 41454, Phoenix, Arizona.

*Primary Examiner*—David H. Brown

*Attorney, Agent, or Firm*—Nydegger & Associates

[57] ABSTRACT

A high impact low penetration round includes a transparent casing and a plurality of deformable pellets fired from the casing as projectiles. The pellets are formed of a lead wax material that flattens and deforms upon contact with a solid object. Contact with a solid object discharges all of the kinetic energy associated with firing the pellet and transfers this energy to the object so that the pellet will not ricochet or penetrate the object. The pellets are shaped to tumble in the air to enhance energy loss and to aid in the detachment and distribution of the pellets. The rounds can be used as shotgun ammunition at close range to provide an effective anti personnel round with a lethality that diminishes rapidly after an effective range of about thirty-five yards.

12 Claims, 1 Drawing Sheet

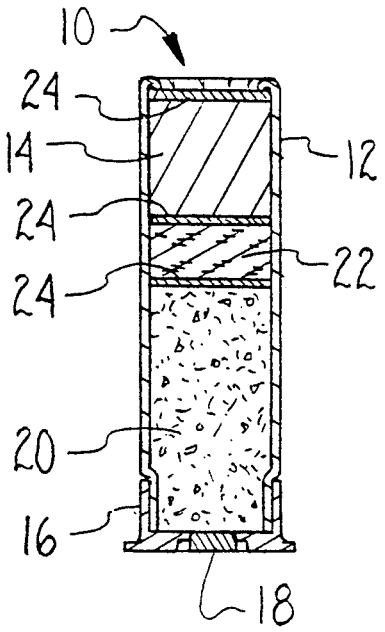
Fig. 1 (PRIOR ART)
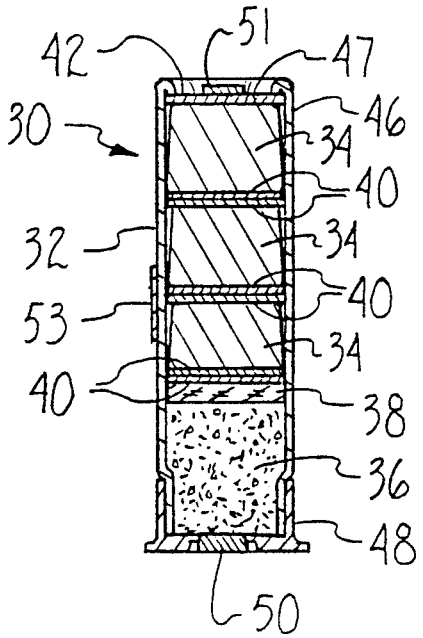
Fig. 2
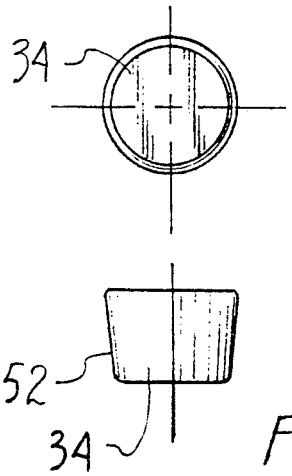
Fig. 3B
Fig. 3A
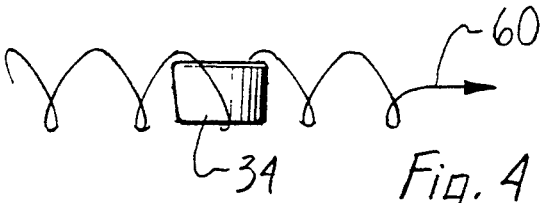
Fig. 4
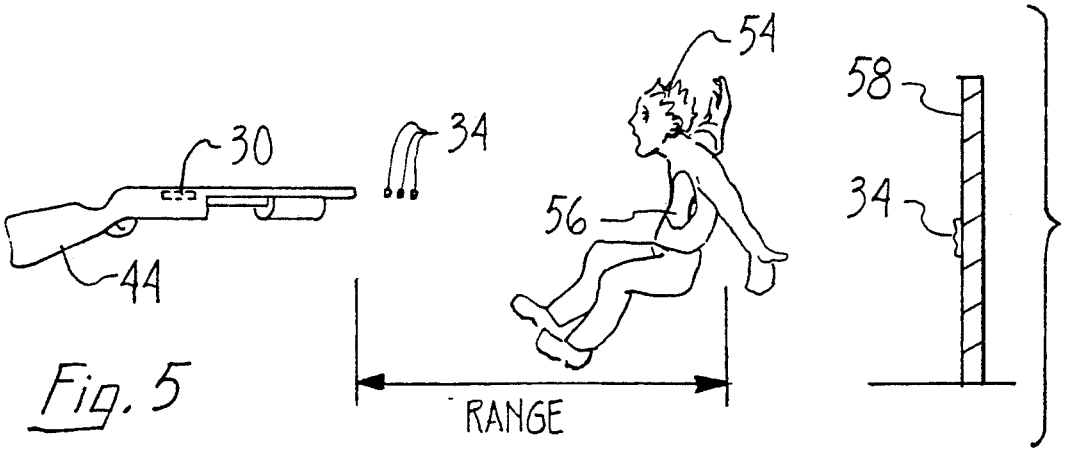
Fig. 5

HIGH IMPACT-LOW PENETRATION ROUND

TECHNICAL FIELD

This invention relates generally to firearms. More specifically the invention relates to ammunition for firearms. The present invention is particularly although not exclusively useful as an antipersonnel shotgun round having a high impact low penetration projectile

BACKGROUND OF THE INVENTION

Various types of ammunition for firearms such as handguns, rifles, and shotguns are well known in the art. Different types of ammunition are suited to different purposes. A problem with most types of ammunition in use today is that the projectiles which are fired by the ammunition have the capability of passing through or ricocheting from solid objects such as walls and doors. This increases the destructive range of firearms and subjects a greater number of people to danger from ricocheting or stray projectiles.

For law enforcement officials having to discharge weapons at close range in crowded urban environments, the problems associated with discharging firearms are compounded. Ammunition fired at a person or object for instance, has the capability of injuring people other than the intended target. As an example, a bullet fired inside a room can ricochet from a solid object within the room and injure people other than the intended target. Alternately the bullet may penetrate and completely pass through the walls of the room and injure someone in another room or someone outside the structure. In general, any type of conventional ammunition formed with a projectile of a hard material such as metal (i.e. lead) will have the capability of ricocheting off or penetrating objects, without a significant loss of energy.

In addition to this shortcoming of conventional ammunition, some projectiles, such as a lead bullet fired at a high velocity, may expend very little energy during flight and even upon impact. Such a projectile may pass completely through non vital body structure, with little transfer of kinetic energy, and not knock down or render a targeted person incapable of retaliatory action.

In order to address some of these problems different types of ammunition, having projectiles formed of a relatively soft material such as wax, rubber or plastic are known in the art. It is also known to utilize a granular material such as salt as a projectile in shot gun shells. In general, however, such ammunition although having low penetration with respect to solid objects, does not have the personnel stopping power necessary to enable such ammunition to be even minimally effective as anti personnel ammunition. The use of this type of ammunition is therefor not suitable to everyday law enforcement and is restricted to very special situations.

Another type of specialized ammunition is known as a Hatton round. This type of ammunition is used in the United States almost exclusively by the military and is adapted mainly for removing door locks and hinges from their supporting structure. A Hatton round 10 is shown in cross section in FIG. 1. The Hatton round 10 is formed as a twelve gage shotgun shell and includes a cylindrical casing 12 and a cylindrical slug 14 loaded into the casing 12. The casing 12 is formed with a brass base portion 16 wherein a primer 18 is mounted. The Hatton round 10 also includes a gunpowder charge 20, and a cork wad 22. In addition, the Hatton round 10 includes seals 24 located within the casing 12 on either side of the wad 20 and between the top surface of the slug 14 and open end of the casing 12. The seals 24 function to maintain separation of the gunpowder 20, wad 22, slug 14, and casing 12.

The slug 14 of the Hatton round 10 is formed of a high melting point wax-lead material weighing about 50 grams. Such a relatively soft material will cause the slug 14 to flatten and deform upon impact. At the same time, the slug material has enough density and mass to transmit considerable impact force when propelled at a high velocity. This allows the slug 14 to be directed at a point blank range at a door or door lock and to blast away a relatively large section of the door. A door can thus be quickly removed for storming a house.

In general, the use of a Hatton round 10 has been limited to specialized applications, as such rounds do not have the accuracy or range necessary to enable their use as anti personnel ammunition. In its intended use the Hatton round 10 is fired at point blank range at a stationary door hinge. Factors such as range, accuracy, and personnel stopping power are therefore not considered in the design of a Hatton round 10.

The present invention recognizes, however, that some of the considerations useful in constructing specialized ammunition, such as a Hatton round, may be utilized in the construction of general purpose anti personnel ammunition. In particular a round can be constructed to be accurate over a limited range and to have a reduced down range lethality. Moreover such a round may be constructed to not penetrate or ricochet from solid objects yet to impart a relatively high impact force for injuring a person.

Accordingly it is an object of the present invention to provide a high impact low penetration round suitable for use by law enforcement officials and others as anti personnel ammunition. It is another object of the present invention to provide a high impact low penetration round that discharges a plurality of projectiles that expend all of their kinetic energy upon impact or in flight. It is another object of the present invention to provide a high impact low penetration round having a projectile that will not ricochet from or penetrate solid objects such as a wall or door of a house. It is another object of the present invention to provide a high impact low penetration round that is accurate within a close limited range. It is yet another object of the present invention to provide a high impact low penetration round with a projectile that is effective for immediately stopping and incapacitating a person at close range but is non lethal down range. Finally it is an object of the present invention to provide a high impact low penetration round that is simple in construction and relatively inexpensive to manufacture.

SUMMARY OF THE INVENTION

In accordance with the present invention a high impact low penetration round is provided. The round is constructed as twelve gage shotgun ammunition and includes a transparent outer casing loaded with a gunpowder charge and a plurality of deformable pellets fired from the casing as projectiles. Preferably three pellets are loaded into a casing. The pellets are formulated of a material that flattens and deforms totally upon contact with a solid object. Contact with any solid object deforms the pellet to such an extent that essentially all of the kinetic energy of the pellet at impact is discharged by the impact and transferred to the solid object. A pellet will thus not ricochet from or penetrate into a solid object.

Each pellet is generally frusto conically shaped. This shape creates unequal air pressure on the pellets in flight and causes the pellets to tumble rapidly in the air. This tumbling enhances the kinetic energy losses during flight and helps to transfer kinetic energy at impact to the solid object. Additionally, the tumbling of the pellets, along with pellet wads located between adjacent pellets, aids in the detachment and initial distribution of the pellets at firing.

In addition to the three pellets and gunpowder charge, the round includes an overpowder wad, pairs of pellet wads on either side of each pellet for maintaining separation of the pellets, and an over shot wad for packing the pellets into the casing. The round is designed to be accurate within a short range (i.e. 30–50 yards). This accuracy is improved by the number, size, and shape of the pellets and by the separation of the pellets during flight. Separation of the pellets is enhanced by the pellet wads maintaining separation of the pellets within the casing and by the tumbling action initiated after firing by the frusto conical shape of the pellets.

Moreover, the pellets are designed to have a lethality that decreases downrange after a short limited range. The down range lethality is decreased by the loss of kinetic energy with the pellets tumbling in flight, and by the total transfer of the kinetic energy of a pellet to a solid object upon impact.

The round may also include a tactile identification means such as a raised dot to permit tactile identification of the round and a temperature detection means such as a heat sensitive paint to indicate temperature abuse of the round.

The features of this invention, both as to its structure and operation, are further understood from the accompanying drawings, taken in conjunction with the accompanying description, in which similar reference characters refer to similar parts.

BRIEF DESCRIPTION OF THE DRAWINGS

FIG. 1 is a cross sectional view of a prior art Hatton round;,

FIG. 2 is a cross sectional view of a high impact low penetration round constructed in accordance with the present invention;

FIG. 3A is a side elevation view of a pellet or projectile of the round shown in FIG. 2;

FIG. 3B is a plan view of FIG. 3A;

FIG. 4 is a schematic view of the flight path of a fired pellet of a round constructed in accordance with the present invention; and FIG. 5 is a schematic view of a firearm discharging a high impact low penetration round constructed in accordance with the present invention.

DESCRIPTION OF PREFERRED EMBODIMENTS

Referring now to FIG. 2 a high impact low penetration round constructed in accordance with the invention is shown and generally designated as 30. The round 30 includes a casing 32, a plurality of pellets 34 loaded into the casing 32, and a gunpowder charge 36 for firing the pellets 34 as projectiles. The round 30 also includes an over powder wad 38 for packing the gunpowder charge 36, pairs of pellet wads 40 on either side of each pellet 34 for separating the pellets 34, and an over shot wad 42 for packing the assembly.

The casing 32 is formed as a shotgun shell for use with a firearm such as a shotgun 44 (FIG. 5). By way of example, and not limitation, the casing 32 is sized as a 12 gage shotgun shell with an overall length of about 2.75 inches. The casing 32 includes a transparent plastic upper portion 46 having an open end 47 and a high brass base portion 48. A primer assembly 50 is mounted within the high brass base portion 48. The casing 32 may be purchased as a premanufactured item from an ammunition manufacturer such as Fiocchi of Italy.

Referring to FIGS. 3A and 3B an individual pellet 34 for the round 30 is shown. The round 30 may include one or more of the pellets 34. A preferable number of pellets 34 is three. In general, in a twelve gage round, three pellets 34 can be made with an overall size and shape that allows a satisfactory accuracy within a range of about thirty to fifty yards.

The pellets 34 may be formed of a material that totally deforms or flattens upon impact. One such material is a lead/wax mixture. By way of example, each pellet 34 may be formed of such a lead/wax material having about a nine to one to about a three to one ratio by weight of lead to wax. An exemplary ratio is about 8.5 parts lead to one part of wax. Depending on the types of lead and wax used and the ratios thereof the pellets 34 may be formulated to shatter on impact or to splat.

Using an 8.5 to ratio, each pellet will weigh approximately 0.59 ounces. With three pellets 34 in a round 30, this provides a total weight for the projectiles of about 1.7 to 1.8 ounces per round 30. In general heavier pellets will be more accurate at longer ranges and may be used with slower burning gunpowder at lower velocities.

For forming the pellets 34, powdered lead may be melted and blended with melted wax in the desired ratio. The blended mixture can then be molded and hardened into the desired shape. As an example the lead may be an extremely fine lead powder (i.e. talc grade) such as an S.F.P. blown lead powder.

The wax used to form the pellets 34 is preferably a microcrystalline wax having a hardness measured on a standard penetration scale of from about 6 to 17. As an example the wax may be an AMBER 175 having a hardness of 17 on the standard penetration scale.

Each pellet 34 is generally frusto conical in shape. In other words each pellet 34 is formed as a cone having a truncated top portion. The conical angle however is very small (i.e. 1% to 2%). A sidewall 52 of the pellet 34 is thus slightly tapered from a large O.D. to a smaller taperedo O.D. A representative taper may be from about a 0.720 inch large O.D. to about a 0.680 small O.D. with a total height of about 0.50 inches. Such a frusto conical cross sectional configuration creates unequal air pressures during flight on the exterior surfaces of the pellet 34 and causes a fired pellet 34 to tumble and wobble along a flight path 60 as shown schematically in FIG. 4. This tumbling action helps the pellets 34 to separate cleanly upon firing and causes the kinetic energy of a fired pellet 34 to be depleted in flight. The lethality of the pellet 34 thus decreases over the range of flight. In addition the tumbling action helps to transfer more ballistic or kinetic energy from the pellet 34 to a target upon impact.

The exterior surfaces of the pellets 34 may also be lubricated with a ballistic lubricant. In general, a pellet 34 having a lubricated exterior surface will accelerate with less powder charge. Moreover lubricated pellets 34 will provide a closer grouping of pellets 34 upon firing. As an example, the pellets 34 prior to loading, may be lubricated using a motor-mica ballistic lubricant.

Referring back again to FIG. 2 each high impact low penetration round 30, in addition to the casing 32 and pellets 34, also includes the gunpowder charge 36 for firing the pellets 34. By way of example the gunpowder charge 36 for a single round 30 with three pellets 34 sized as described above, may include about twenty to thirty-four grains of gunpowder. The gunpowder is preferably smokeless, such as a Winchester WST or W-571 gunpowder. An over powder wad 38 packs the gunpowder charge 36 into the base 48 of the casing 32 with the gunpowder in contact with the primer 50. The over powder wad 38 also functions to separate the gunpowder charge 36 from the pellets 34 and to provide a gas seal upon firing. The over powder wad 38 may be formed of a material such as plastic, paper or cork that is loaded into the casing 32 as is common in the art. By way of example the powder wad 38 may have a thickness of about 0.125 inches.

The pellets 34 are separated from each other and from the over powder wad 38 by pairs of pellet wads. In other words as shown in FIG. 2 two pellet wads 40 are located between the over powder wad 38 and a first pellet 40, and between adjacent second and third pellets 40. The pairs of pellet wads 40 not only function to maintain separation of the pellets 34 within the casing 32 but also help the pellets 34 to separate cleanly upon firing. This improves the accuracy and stopping power of the round 30. By way of example each pellet wad 40 may be formed of a paper or plastic material having a thickness of about 0.03 inches. In general, it has been determined that pairs of pellet wads 40 provide better results than a single pellet wad.

The over shot wad 42 is placed over the open end 47 of the casing 32 to pack the pellets 34 tightly into the casing 32. As with the pellet wads 40, the over shot wad 42 may be formed of paper or plastic material having a thickness of about 0.03 inches. As is common in the art, the plastic upper portion 46 of the casing 32 may be crimped at its open end 47 around the over shot wad 42 to provide a tightly packed assembly. As an example, the powder charge 36 and pellets 34 may be loaded at a pressure of about 70 psig.

The round 30 may also include a tactile identification means. As an example the over shot wad 42 may be formed with a button or raised portion 51 to enable a tactile identification of the round 30. A user can thus identify the round by running a finger over the raised portion 51. Alternately the tactile identification means may be located elsewhere on the round 30.

In addition, the round 30 may be provided with a temperature detection means on an exterior surface to indicate that the round 30 may have been temperature abused or heat soaked to a temperature which may affect its performance. As an example, the temperature detection means may be a dot 53 of a heat sensitive paint that changes colors upon prolonged exposure to a threshold temperature.

With such a high impact low penetration round 30 constructed as described above, a maximum range of the round 30 is about fifty yards. A maximum effective range of the round 30 is about thirty-five yards. A pellet 34 missing the target will give up most of it's ballistic energy passing through any solid object, such as a house wall, door, or partition, such that the chance of an unintentional, fatal injury is dramatically reduced. The possibility of a lethal injury after about fifty yards is extremely remote. In addition, the pellets 34 will not ricochet from any surface and will not pass through a Level II tactical bullet proof vest even at close range.

With reference to FIG. 5, in use, the high impact low penetration round 30 may be fired from a shotgun 44 at a target such as a person 54. Upon firing, the frusto conically shaped pellets 34 separate and tumble along a flight path 60 as indicated by FIG. 4. If the target person 54 is within the effective range of about thirty-five yards, the pellets 34 will spread out upon impact and can produce a gaping wound 56. If the target person 54 is out of the effective range, however, the pellets 34 will have a decreasing effectiveness through the maximum range that is about fifty yards. In other words with the round 30 will exhibit a decreased lethality down range of a target.

A pellet 34 that hits a solid object such as a wall 58 will not ricochet from the wall 58. Instead the pellet 34 will deform upon impact with the wall 58 and either stick to the wall 58 or drop harmlessly to the floor. All of the kinetic energy associated with firing the pellets 34 is thus expended by the tumbling flight path or by the energy of impact.

The high impact low penetration round 30 of the invention can thus be used effectively as anti personnel ammunition with the possibility of unintended injury dramatically reduced. The round 30 may also be used in a manner similar to the prior art Hatton round 10 for removing door locks and hinges from a supporting structure.

While the particular round as herein shown and disclosed in detail is fully capable of obtaining the objects and providing the advantages hereinbefore stated, it is to be understood that the round is merely illustrative of the presently preferred embodiments of the invention and that other embodiments are possible within the scope of the present invention.

I claim:

1. A high impact low penetration round for a shotgun comprising:
   - a casing having an open end and a base portion with a primer;
   - a gun powder charge loaded into the base portion in contact with the primer;
   - a plurality of pellets loaded into the casing above the gunpowder charge for firing by the gunpowder as projectiles from the casing, with each pellet formed of a lead wax material deformable upon impact with a solid object to transfer essentially all kinetic energy to the solid object upon impact, and with each pellet having a generally frusto conical shape to cause the pellets to tumble and lose kinetic energy in flight;
   - an over powder wad loaded into the casing between the gunpowder charge and pellets; and
   - a pellet wad separating each pellet from an adjacent pellet.

2. The round as claimed in claim 1 and wherein there are three pellets.

3. The round as claimed in claim 2 and further comprising temperature detection means for indicating that the round has been exposed to a temperature that may affect its performance.

4. The round as claimed in claim 3 and further comprising tactile identification means for identifying the round using the sense of touch.

5. The round as claimed in claim 4 and wherein the pellets are formed of lead and wax combined in a ratio by weight of between about nine to three parts lead to about one part of wax.

6. A high impact low penetration round for a twelve gage shotgun comprising:

a twelve gage shotgun shell casing having an open end and a base portion with a primer;

a charge of gunpowder loaded into the base of the casing;

an over powder wad placed over the gunpowder;

a plurality of pellets placed on the over powder wad for firing by the gunpowder charge as projectiles from the casing, each pellet formed of a lead/wax material deformable upon impact with a solid object to transfer essentially all of the kinetic energy of a pellet to the solid object and each pellet having a generally frusto conical shape with a tapered sidewall to cause unequal air pressure and tumbling of the pellets during flight to expend kinetic energy during flight and to aid the transfer of kinetic energy to the solid object upon impact;

a plurality of pellet wads for separating each of the pellets from one another such that the pellets will separate upon firing; and an over shot wad placed over the open end of the casing to pack the pellets into the casing.

7. The round as claimed in claim 6 and wherein there are three pellets.

8. The round as claimed in claim 7 and further comprising tactile identification means formed on the round.

9. The round as claimed in claim 8 and wherein the tactile identification means comprises a raised dot formed on the over shot wad.

10. The round as claimed in claim 9 and further comprising heat detection means formed on the round.

11. The round as claimed in claim 10 and wherein the heat detection means comprises a heat sensitive paint.

12. The round as claimed in claim 11 and wherein the pellet wads are loaded in pairs.

* * * * *